US005817184A

United States Patent [19]

Lawrence

[11] Patent Number: 5,817,184

[45] Date of Patent: Oct. 6, 1998

[54] INDUSTRIAL CLEANING APPARATUS AND METHOD

[76] Inventor: John Webb Lawrence, 4527 Arcady Ave., Dallas, Tex. 75205

[21] Appl. No.: 739,900

[22] Filed: Oct. 30, 1996

[51] Int. Cl.[6] ..... B08B 9/093; E04H 15/14; F26B 3/08; F26B 5/04

[52] U.S. Cl. ..... 134/22.12; 134/22.18; 134/93; 34/362; 34/366; 34/511; 34/413; 34/435; 34/436; 118/308; 239/8; 239/9; 239/10; 239/66

[58] Field of Search ..... 34/362, 366, 511, 34/413, 435, 436; 118/308; 239/8, 9, 10, 66; 134/22.12, 22.18, 93

[56] References Cited

U.S. PATENT DOCUMENTS 1,672,904 6/1928 Randall ..... 220/410
4,713,094 12/1987 Yanagawa et al. ..... 55/163
5,238,154 8/1993 Zuriel ..... 222/189
5,335,703 8/1994 DeJong ..... 141/20

*Primary Examiner*—Kenneth R. Horlick
*Assistant Examiner*—Joyce Tung
*Attorney, Agent, or Firm*—Michael A. O'Neil

[57] ABSTRACT

A cleaning apparatus capable of supplying on a substantially continuous basis an anhydrous agent and water to an area to be cleaned. The cleaning machine includes an inner enclosure disposed in an interior chamber of an outer enclosure. The outer enclosure is designed to enclose the interior chamber. Also, provided in the cleaning apparatus is a system for purging the interior chamber with dry air. The inner enclosure contains the anhydrous agent, which is typically baking soda. The inner enclosure further includes a system for distributing the anhydrous agent to a cleaning nozzle.

20 Claims, 3 Drawing Sheets

INDUSTRIAL CLEANING APPARATUS AND METHOD

TECHNICAL FIELD

The present invention relates generally to an industrial cleaning apparatus. More particularly, the invention relates to a cleaning apparatus that supplies an anhydrous agent substantially free of the undesired effect of moisture causing the anhydrous agent to coagulate.

BACKGROUND OF THE INVENTION

Cleaning machines utilizing a combination of water and anhydrous agents are frequently used in cleaning operations. A general anhydrous agent used in industrial cleaning is granular baking soda. The mixture of baking soda and water is useful in cleaning dirt, protein, rust, grease, and various other residues. There are several designs of industrial cleaning machines currently available on the market.

The supply of baking soda used in cleaning operations is susceptible to moisture absorption causing the baking soda to coagulate. The coagulation of baking soda clogs various valves and nozzles of the cleaning machine thereby causing an interruption of the cleaning operation. The undesirable effect of coagulating baking soda into a viscous or coherent mass is common in cleaning operations where water is an integral component. A cleaning machine ceases to function properly when the supply of baking soda comes in contact with water or humid air prior to mixing with water.

Presently, cleaning machines utilize a container for the supply of baking soda. The container is constantly exposed to humid air and water during the cleaning operation. A shut-down of cleaning operations necessarily follows exposure of baking soda supply to moisture. The moisture is introduced into baking soda as a result of humid air flowing through the container, while drawing the baking soda into a nozzle for mixture with water during a cleaning operation.

An additional source of moisture is condensation forming in the container. The condensation is particularly troublesome in indoor cleaning operations where there are high concentrations of humidity and steam. Meat or poultry facilities are common locations where condensation and moisture typically cause a cleaning machine to clog up.

Accordingly, there is a need for a cleaning machine to continuously and reliably supply granular baking soda during operation. Additionally, a cleaning machine is needed that is low in cost, functional, and able to be configured in different sizes.

SUMMARY OF THE INVENTION

The present invention is a cleaning apparatus capable of supplying on a substantially continuous basis an anhydrous agent and water to an area to be cleaned. The cleaning machine includes an inner enclosure disposed in an interior chamber of an outer enclosure. The outer enclosure is designed to enclose the interior chamber. Also, provided in the cleaning apparatus is a system for purging the interior chamber with dry air. The inner enclosure contains the anhydrous agent, which is typically baking soda. The inner enclosure further includes a system for distributing the anhydrous agent to a cleaning nozzle.

According to the present invention there is provided a cleaning apparatus having an inner enclosure surrounded by dry air, such that dry air comes in contact with the anhydrous agent during operation.

Also in accordance with the present invention there is provided a cleaning apparatus that functions in an environment where high humidity and steam are present.

Further, in accordance with the present invention there is provided an outer enclosure of a cleaning machine that minimizes the drawing of moisture into the outer enclosure.

BRIEF DESCRIPTION OF THE DRAWINGS

A more complete understanding of the invention may be had by reference to the following Detailed Description when taken in conjunction with the accompanying Drawings wherein.

DETAILED DESCRIPTION OF THE DRAWINGS

Figure 1:
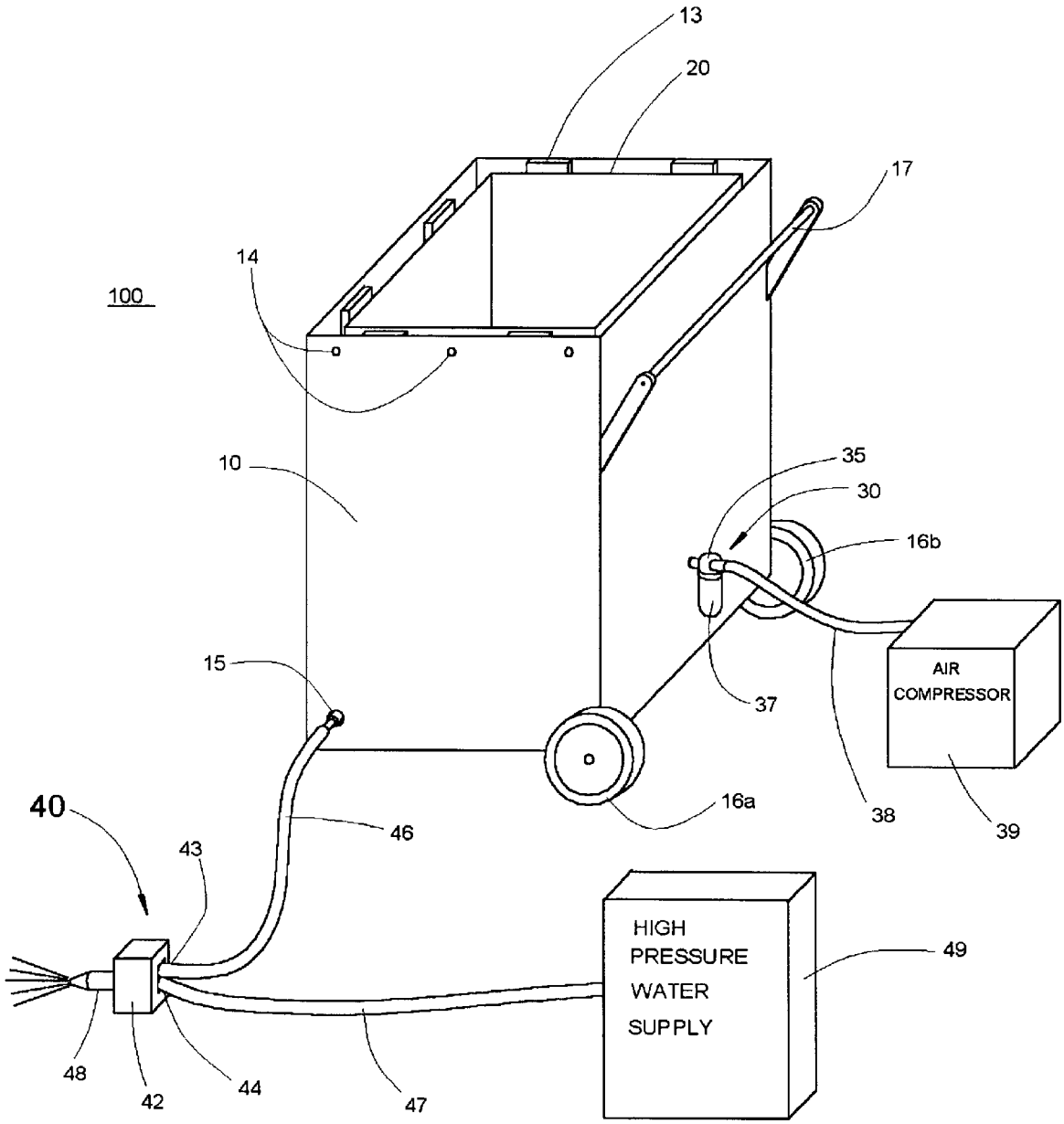
FIG. 1 is a perspective view of the cleaning apparatus of the present invention connected to an air compressor and high pressure water supply with the cover of an outer enclosure removed.

Referring to the drawings, wherein like numerals represent like parts throughout the several views, there is generally disclosed a cleaning machine 100 in accordance with the present invention.

Although the example of a cleaning machine 100 utilizing an anhydrous agent (not shown) will be discussed herein, those skilled in the art will appreciate that such application is only one of many utilizing the principles of the present invention. Accordingly, the cleaning machine 100 described herein should not be construed in a limiting manner.

Figure 5:
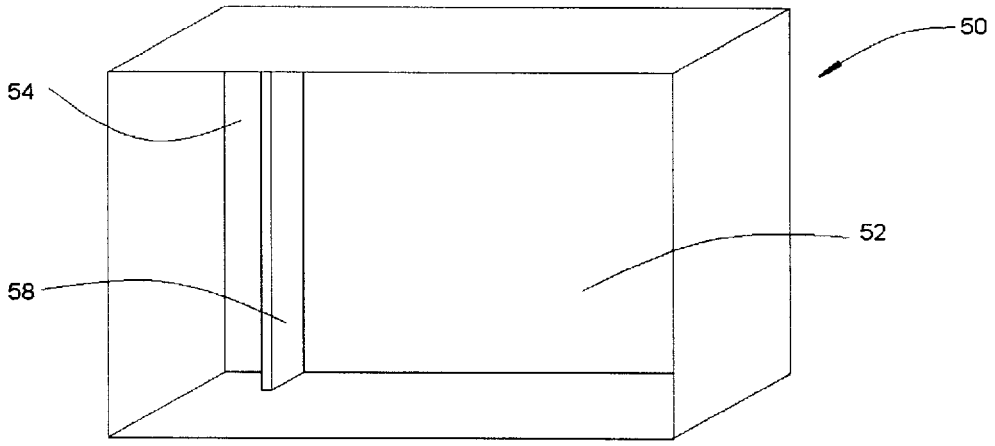
FIG. 5 is a perspective view of the cover illustrating an interior portion and extended portion separated by an internal partition.

Referring to FIG. 1, the cleaning machine 100 includes an outer enclosure 10, an inner enclosure 20, a purge system 30, a distributor nozzle 40 and a cover 50 as shown in FIG. 5. During the operation of cleaning machine 100, the inner enclosure 20 is disposed in an interior chamber 11 of the outer enclosure 10. The outer enclosure 10 includes an upper opening 12 that is closed by the cover 50. The purge system 30 introduces dry air into the lower part of the interior chamber 11. The dry air surrounds the inner enclosure 20, which typically contains baking soda as an anhydrous agent. The purge system 30 and outer enclosure 10 function to minimize moisture coming in contact with the baking soda to minimize coagulation. The distributor nozzle 40 directs a desired quantity of baking soda from the inner enclosure 20 to an area to be cleaned as will be described.

In the preferred embodiment, the outer enclosure 10 has a rectangular configuration and inner enclosure 20 has a trapezoidal configuration. The invention, however, is not limited to specific sizes and configurations of the various enclosures.

Figure 2:
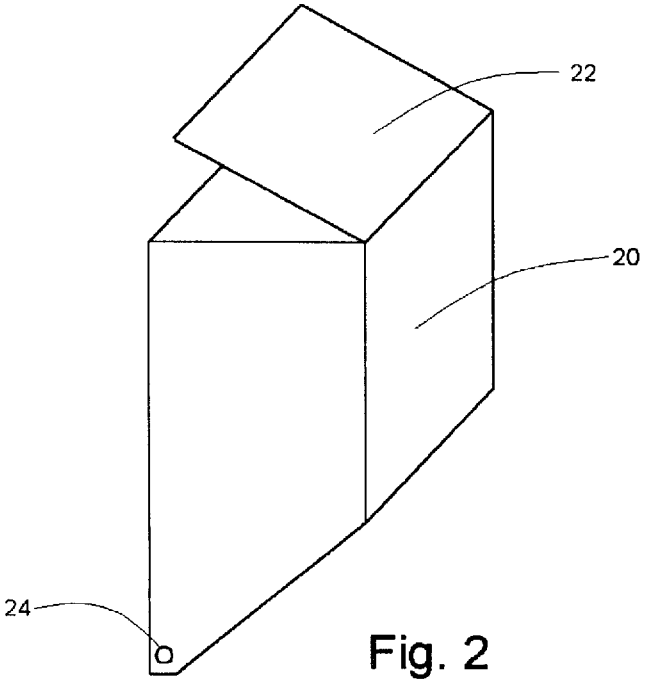
FIG. 2 is a perspective view of an inner enclosure of the cleaning apparatus of FIG. 1.

Referring to FIG. 2, there is illustrated the inner enclosure 20, having a lid 22 hinged to one side and exit opening 24 near the bottom of enclosure 20. The bottom location is preferable in that gravity will assist the flow of baking soda during operation. The inner enclosure 20 in one embodiment of the invention holds approximately 200 pounds of granular baking soda. A trapezoidal configuration ensures that the baking soda will fall to the area of the exit opening 24 and provides space in the interior chamber 11 for distribution of dry air from the purge system 30. The lid 22 contains the baking soda in the inner enclosure 20 and offers additional protection from moisture. Typically the lid 22 is hinged to the inner enclosure 20; however, other means are permissible and considered within the scope of the present invention.

Figure 3:
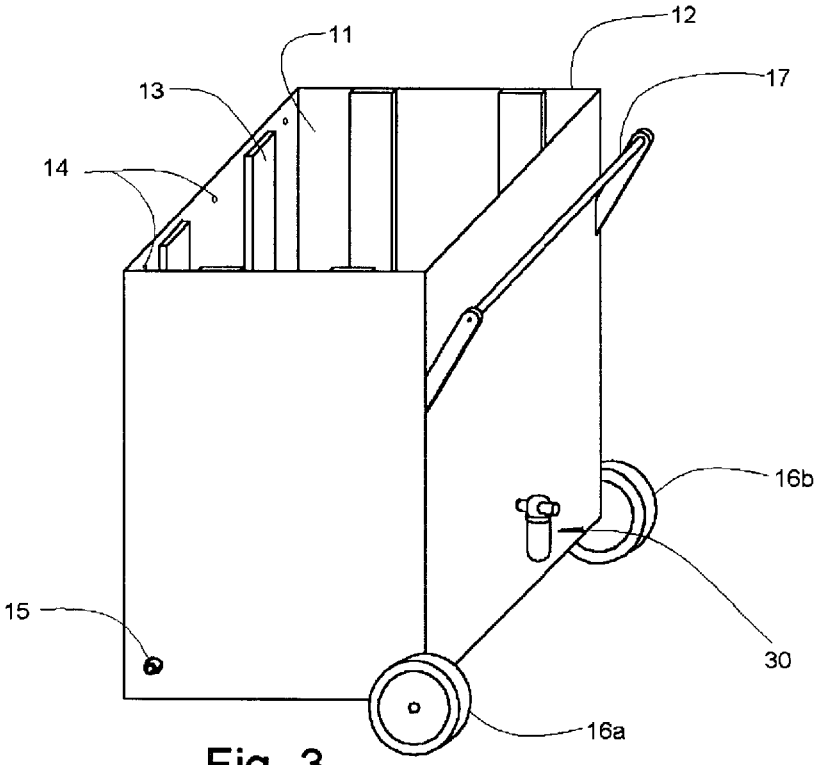
FIG. 3 is a perspective view of the outer enclosure of FIG. 1 without the inner enclosure disposed therein.
Figure 4:
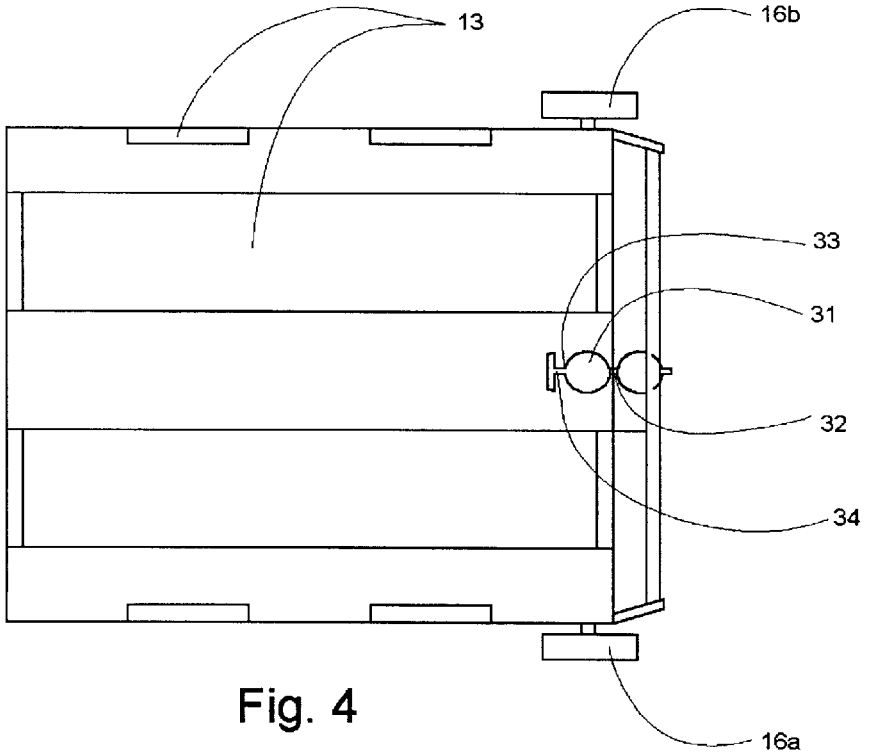
FIG. 4 is a top view of the outer enclosure of the cleaning apparatus of FIG. 3.

Referring to FIGS. 3 and 4, there is illustrated the outer enclosure 10 and a portion of the purge system 30. The outer enclosure 10 includes the interior chamber 11, an upper opening 12, spacer bars 13, at least one relief valve 14, an exit opening 15, wheels 16*a* and 16*b* and a handle 17. The outer enclosure 10 is sized to hold the inner enclosure 20, such that a user with relative ease can insert and remove the inner enclosure 20.

The walls and bottom of the interior chamber 11 support spacer bars 13 to position the inner enclosure 20 to permit the flow of dry air around the inner enclosure 20. The spacer bars 13 thereby function to insure a majority of the inner enclosure 20 is exposed to dry air. The spacer bars 13 may have a variety of measurements and still be within the principles of the present invention. In the present embodiment, the support bars 13 are strips of metal secured to the walls of the interior chamber 11.

The top of the inner enclosure 20 is disposed below the level of the upper opening 12 of the outer enclosure 10. The location of the inner enclosure 20 in the outer enclosure 10 insures that the lid 22 is exposed to dry air.

The outer enclosure 10 contains at least one relief valve 14 to release dry air into the surrounding environment should a build-up of pressure develop in the outer enclosure.

Referring to FIG. 5, there is illustrated the cover 50 sized and configured to fit over the upper opening 12 of the outer enclosure 10. The cover 50 includes an interior area 52, an extended area 54 and an internal partition 58. In the present embodiment, the cover 50 is not hinged to the outer enclosure 10 but rather fits over the outer enclosure 10 to further insure that moisture does not enter the inner enclosure 20. However, a hinged cover 50 is considered to be within the scope of the present invention.

The cover 50 includes the interior area 52 that is sized to fit over the upper opening 12 of the outer enclosure 10. The internal partition 58 is positioned to a side of the outer enclosure 10 having the relief valves 14.

A function of the extended area 54 is to shield the relief valves 14. The extended area 54 coupled with the deep sides of the cover 50 further reduces the possibility of moisture entering the interior chamber 11 as a result from a direct spray of water towards the relief valves 14.

Referring to FIGS. 1 and 4, there is illustrated the purge system 30 located both inside and outside of the outer enclosure 10. The purge system 30 is connected to an air compressor 39 by means of a hose 38. The air compressor 39 is a commercially available unit either portable or stationary. The air compressor 39 provides dry air through the purge system 30 to surround the inner enclosure 20.

The purge system 30 includes a pressure regulator 31, an exhaust manifold 34, a quick connector 35 and a moist air trap 37. The components of the purge system 30 are individually commercially available and it will be appreciated that various versions and configurations of the purge system are consistent with the principles of the present invention.

The pressure regulator 31 is located in the interior chamber 11; however, other locations are permissible. The pressure regulator 31 has a first coupling 32 and a second coupling 33 where the first coupling 32 connects to the quick connector 35. The quick connector 35 is located outside of the outer enclosure 10 and provides an efficient way to connect to the air compressor 39.

The second coupling 33 of the pressure regulator 31 is connected to the exhaust manifold 34. The exhaust manifold 34 is configured to effectively distribute dry air within the interior chamber 11. The exhaust manifold 34 is preferably a T-type fitting; however, various shapes are considered functional equivalents.

The moist air trap 37 is connected to the quick connector 35 and the pressure regulator 31. The moist air trap 37 is located outside of the outer enclosure 10. A function of the moist air trap 37 is to collect moisture present in the air received from the air compressor 39.

Referring again to FIG. 1, there is illustrated a distribution nozzle 40 that directs a desired quantity of anhydrous agent from within the inner enclosure 20 to the area to be cleaned. The distribution nozzle 40 is connected to a water hose 47 that in turn connects to a high pressure water supply 49. The high pressure water supply 49 is commercially available and well-known in the art.

The distribution nozzle 40 includes a spray chamber 42 connected to a supply tube 46 and connected to the water hose 47. The spray chamber 42 further includes a first input 43, a second input 44 and an output 48. The water hose 47 connects the second input 44 of the spray chamber 42 to the high pressure water supply 49. The supply tube 46 connects the first input 43 of the spray chamber 42 to the exit opening 24 of the inner enclosure 20. A waterproof sealant is applied around the perimeter of the supply tube 46 at the exit opening 15 of the outer enclosure 10.

The spray chamber 42 is designed to produce a venturi effect permitting a user to control the desired quantity of anhydrous agent to be drawn from the inner enclosure 20. The venturi effect results from the flow of water that creates a suction to draw a desired quantity of anhydrous agent from the inner enclosure 20. The agent is drawn into the spray chamber 42 and combined with the water. The desired combination of anhydrous agent and water is directed from the output 48 to the area to be cleaned.

While the present invention has been described with reference to the illustrated embodiment, it is not intended to limit the invention, but on the contrary, it is intended to cover such alternatives, modifications, and equivalents as may be included in the spirit and scope of the invention as defined in the following claims.

I claim:

1. An apparatus for supplying anhydrous agent to an area to be cleaned, comprising:

an outer enclosure having an interior chamber;

an inner enclosure disposed in the interior chamber of the outer enclosure for receiving the anhydrous agent therein;

means for filling the interior chamber with a dry gas thereby surrounding the anhydrous agent with dry gas and thus preventing moisture from contracting the anhydrous agent within the interior chamber; and means connected to the inner enclosure for distributing the anhydrous agent from within the inner enclosure to the area to be cleaned.

2. An apparatus in accordance with claim 1 wherein the outer enclosure further comprises supports for positioning the inner enclosure in the interior chamber.

3. An apparatus in accordance with claim 2 wherein the supports comprise a plurality of bars attached to walls of the interior chamber, said bars supporting the inner enclosure in the interior chamber.

4. An apparatus in accordance with claim 1 wherein a top of the inner enclosure is positioned below a top of the outer enclosure.

5. An apparatus in accordance with claim 1 wherein the outer enclosure further includes relief valves for the interior chamber.

6. An apparatus in accordance with claim 5 wherein the relief valves comprise at least one opening in the outer enclosure.

7. An apparatus in accordance with claim 5 further comprising a cover removably positioned over both the outer enclosure and the relief valves to minimize the entry of moisture into the interior chamber.

8. An apparatus in accordance with claim 1 wherein the means for purging comprises a pressure regulator having a first and second coupling, the first coupling in communication with a quick connector in communication with a gas supply, and the second coupling located in the interior chamber.

9. An apparatus in accordance with claim 8 wherein the means for purging further includes a moisture trap coupled between the quick connector and the pressure regulator.

10. An apparatus in accordance with claim 8 wherein the means of purging further includes an exhaust manifold in communication with the second coupling and sized and configured to distribute dry air around the inner enclosure.

11. An apparatus in accordance with claim 1 wherein the means for distributing comprises a nozzle coupled by means of a tube to the inner enclosure, the nozzle having an input in fluid communication with a water supply, wherein a venturi effect resulting from an increase in flow of water through the nozzle creates a suction to draw a desired quantity of the anhydrous agent from the inner enclosure to be combined with the water and directed toward the area to be cleaned.

12. An apparatus in accordance with claim 1 wherein the outer enclosure further comprises a plurality of bars attached to walls of the interior chamber, said bars supporting the inner enclosure in the interior chamber.

13. An apparatus in accordance with claim 12 wherein the outer enclosure further includes relief valves for the interior chamber.

14. An apparatus in accordance with claim 13 further comprising a cover removably positioned over both the outer enclosure and the relief valves to minimize the entry of moisture into the interior chamber.

15. An apparatus in accordance with claim 14 wherein the filing system further includes:

a pressure regulator having a first and second coupling, the first coupling in communication with a quick connector in communication with a gas supply, and the second coupling located in the interior chamber; and a moisture trap coupled between the quick connector and the pressure regulator.

16. An apparatus in accordance with claim 15 further comprising a nozzle assembly which comprises a spray chamber coupled by means of a tube to the inner enclosure, the spray chamber having an input in fluid communication with a water supply, wherein a venturi effect resulting from an increase in flow of water through the spray chamber creates a suction to draw a desired quantity of the anhydrous agent from the inner enclosure to be combined with the water and directed toward the area to be cleaned.

17. A method for distributing an anhydrous agent from an inner enclosure within an interior chamber of an outer enclosure to an area to be cleaned, comprising the steps of:

receiving the anhydrous agent to be distributed into the interior chamber;

filling the interior chamber with dry gas and thereby preventing contamination of the anhydrous agent by moisture; and distributing the anhydrous agent from within the inner enclosure to the area to be cleaned.

18. A method in accordance with claim 17 wherein the step of purging further comprises:

regulating the pressure within the interior chamber; and collecting moisture from a gas supply prior to introducing dry air into the interior chamber.

19. A method in accordance with claim 17 wherein the step of distributing further comprises:

drawing a desired quantity of the anhydrous agent from the inner enclosure;

combining the desired quantity of the anhydrous agent with water; and directing the desired quantity of the anhydrous agent and the water to the area to be cleaned.

20. A method in accordance with claim 17 wherein the anhydrous agent is baking soda.

* * * * *